United States Patent [19]

Schantz

[11] 4,058,781

[45] Nov. 15, 1977

[54] DOUBLE POLE CONTACT OPERATING MECHANISM

[76] Inventor: Spencer C. Schantz, 16608 W. Rogers Drive, New Berlin, Wis. 53151

[21] Appl. No.: 649,776

[22] Filed: Jan. 16, 1976

[51] Int. Cl.[2] ..... H01H 50/58

[52] U.S. Cl. ..... 335/186; 335/194; 335/200

[58] Field of Search ..... 335/186, 194, 200, 127, 335/128, 135, 189, 192, 164, 238, 200; 200/248, 153 V

[56] References Cited

U.S. PATENT DOCUMENTS

| | | | |
|---|---|---|---|
| 3,484,729 | 12/1969 | Adams et al. | 335/200 |
| 3,684,986 | 8/1972 | Nagamoto et al. | 335/200 |
| 3,733,568 | 5/1973 | Prouty et al. | 335/186 |
| 3,864,652 | 2/1975 | Zubaty et al. | 200/248 |

*Primary Examiner*—Harold Broome

*Attorney, Agent, or Firm*—Wheeler, Morsell, House & Fuller

[57] ABSTRACT

A double pole double throw relay has two flexible electrically conductive contact arms which each carry an electrical contact positioned to engage cooperating contacts. Contact closing pressure is simultaneously applied to both contact arms by a yoke made of electrical insulating material which extends transversely of the arms and is pivotally connected midway of its length to an actuator which is positioned between the contact arms and is movable toward and away from the arms. The pivotal mounting of the yoke tends to equalize the contact closing pressure. In one embodiment, the yoke is supported by yielding means to provide a degree of overtravel which maintains pressure and compensates for contact erosion and water.

13 Claims, 5 Drawing Figures

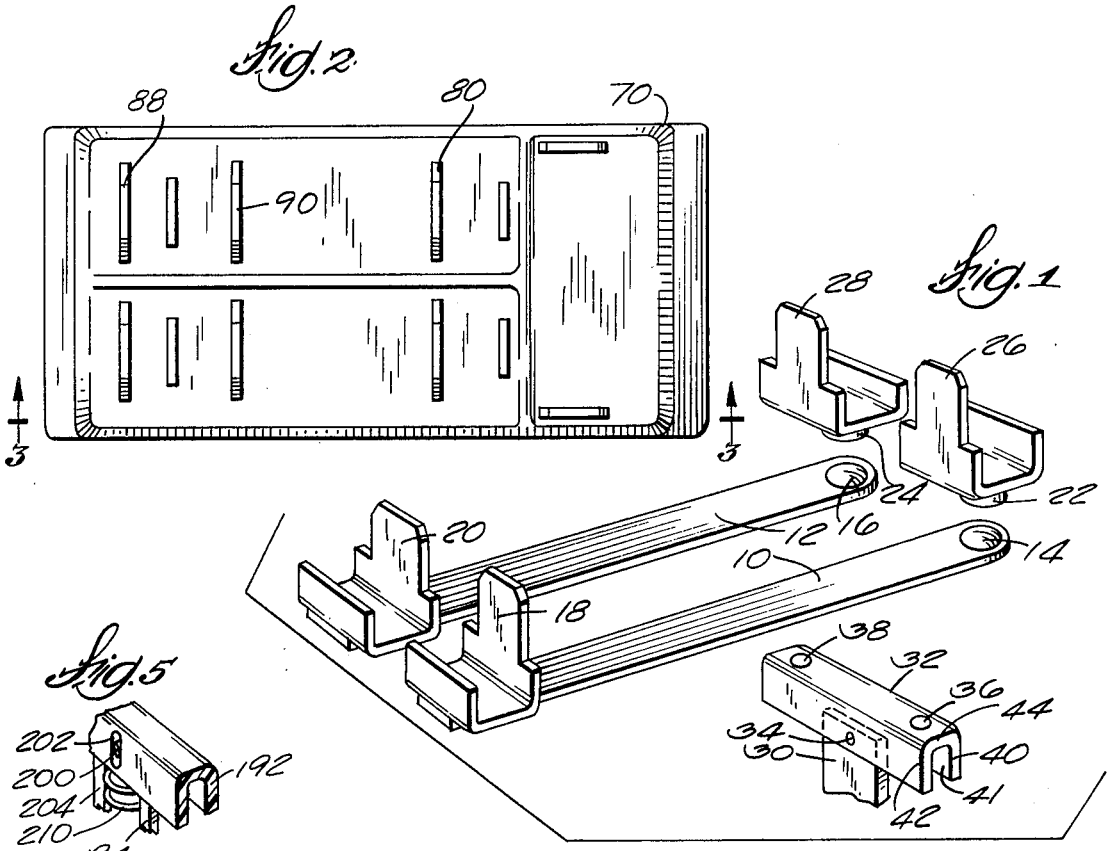
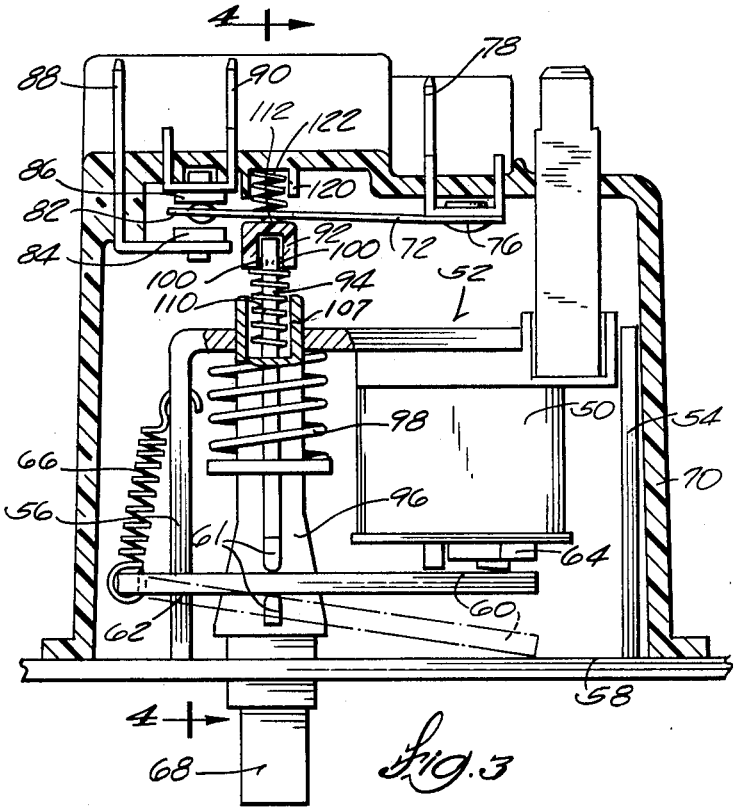
Fig. 3
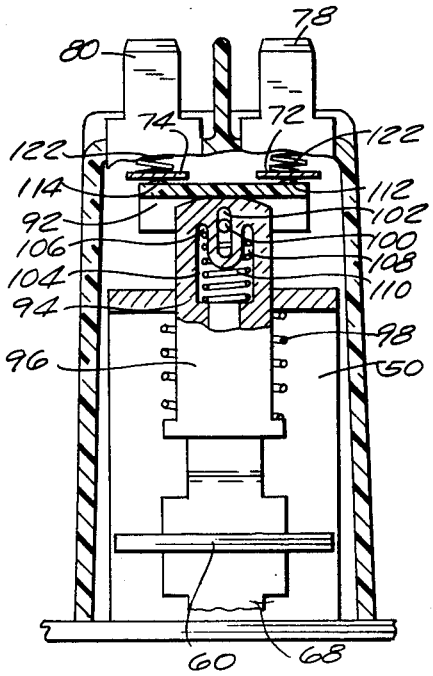
Fig. 4

DOUBLE POLE CONTACT OPERATING MECHANISM

BACKGROUND OF THE INVENTION

This invention relates to double pole relays, switches, or other electrical devices in which contact closing pressure is simultaneously applied to two flexible electrically conductive contact arms.

In the past, the flexible contact arms of double pole relays and double pole push button switches have been mechanically linked together by a rigid linkage, and contact closing pressure for the device has been applied to the contact arms via the rigid linkage. This structure requires a high degree of precision in the manufacture or assembly of the contact supports, contact arms, contact arm linkage, and actuator in order to achieve approximate equalization of contact closing pressure. Also, manual adjustment of the parts is frequently necessary to achieve approximate contact pressure equalization. The principal object of this invention is to provide a novel contact operating structure which achieves a high degree of contact pressure equalization while eliminating the necessity of using precision parts or manual adjustments.

SUMMARY OF THE INVENTION

Contact closing pressure is applied to two flexible electrically conductive contact arms by a yoke of electrical insulating material which extends transversely of both contact arms and is pivotally connected at a medial point to an actuator, the latter being positioned between the contact arms and movable toward and away from said arms. The pivotal mounting of the non-conducting yoke tends to equalize contact pressure and provides high precision operation without precisely manufactured parts or manual adjustments. In one embodiment of the invention the yoke is supported by yielding means to provide a degree of overtravel which compensates for contact erosion and wear. Other objects and advantages of the invention will be apparent from the disclosure hereof.

DESCRIPTION OF THE DRAWINGS

FIG. 1 is a fragmentary perspective view showing the basic elements of this invention embodied in a simple double pole switch, the supporting structure being omitted.

FIG. 2 is a plan view looking at the terminal end of a double pole double throw push button relay utilizing the contact operating structure of this invention.

FIG. 3 is a longitudinal sectional view of the relay of FIG. 2 taken along the line 3—3 of FIG. 2, with the yoke and actuator portions thereof cut away and shown in section to reveal inner details.

FIG. 4 is a fragmentary cross-sectional view taken on the line 4—4 of FIG. 3.

FIG. 5 is a fragmentary perspective view showing a modified arrangement for the pivot in the yoke.

DETAILED DESCRIPTION OF THE INVENTION

FIG. 1 shows the basic parts of a double pole single throw normally open switch or relay in exploded perspective form together with the contact operating structure, the supporting parts being omitted. Two flexible electrically conductive contact arms 10 and 12 carry electrical contacts 14 and 16, respectively, on one end thereof, and are attached by conventional means to electric terminals 18 and 20. Stationary contacts 22 and 24 are mounted on terminals 26 and 28, the latter being supported by conventional means so that the contacts 22 and 24 are opposite contacts 14 and 16, in cooperative relationship therewith, to form two normally open contact pairs.

The contact operating structure of this invention includes an actuator 30 which is positioned between contact arms 10 and 12 and is movable toward and away from the latter. On the end of actuator 30 nearest contact arms 10 and 12, a yoke 32 of electrical insulating material, such as suitable plastic, is pivotally connected to actuator 30 by a pintle pin 34 which passes through the end of actuator 30 and through the yoke 32 midway of the length thereof. The yoke is U-shaped in cross-section, as shown in FIG. 1, to provide a groove 41 receiving the end of the actuator. Yoke 32 extends transversely of the contact arms 10 and 12 in position to contact both of them when actuator 30 is moved a predetermined distance. Semispherical bosses 36 and 38 are preferably but not necessarily formed on the surface of yoke 32 in a position to contact arms 10 and 12. For maximum equalization of contact closing pressure, the distances between the contact point of the boss 36 and the axis of pintle pin 34 should be substantially equal to the distance between the boss 38 and said axis.

When actuator 30 is moved a predetermined distance toward contact arms 10 and 12, bosses 36 and 38 will engage their respective contact arms 10 and 12 and begin to flex arms 10 and 12 to move contacts 14 and 16 toward the cooperating contacts 22 and 24. Due to minor manufacturing variations in the structure for supporting contacts 22 and 24 and contact arms 10 and 12, one of the contact pairs 14–22 and 16–24 will close before the other. When this occurs, yoke 32 will pivot about pintle pin 34 to prevent any substantial contact closing pressure on the closed contact pair until the other contact pair is closed. As the travel of actuator 30 and yoke 32 continues, the contact closing pressure on both contact pairs 14–22 and 16–24 will tend to equalize due to the fact that yoke 32 pivots about pintle pin 34. Thus, the novel contact closing structure of this invention achieves a high degree of contact closing pressure equalization without utilizing precision parts or manual adjustments.

As before mentioned, the particular yoke 32 shown in FIG. 1 is U-shaped in cross-section, and the distance between side walls 40 and 42 is slightly greater than the thickness of actuator 30 to permit pivotal motion of yoke 32 about pintle pin 34. Also, there is enough clearance between the end of actuator 30 and web 44 of yoke 32 to permit sufficient pivotal motion of yoke 32 in groove 41 to accomplish contact pressure equalization. However, it should be understood that this particular pivotal mounting arrangement can be varied and that other cross-sectional shapes can be employed for yoke 32.

FIGS. 2–4 show the application of the contact operating structure of this invention to a double pole double throw push button relay which can be used as a push-to-start switch in conventional home and commercial clothes dryers. Referring to FIG. 3, a conventional relay coil 50 is mounted on a U-shaped ferromagnetic frame 52, the latter having two legs 54 and 56 which are each staked to a ferromagnetic supporting plate 58. A ferromagnetic armature 60 is suitably fulcrumed at 62 to frame leg 56. It can be pivoted about fulcrum 62 between an actuated position in which the free end of armature 60 is held by the magnetic field of coil 50 against pole piece 64 thereof, as shown in solid lines in FIG. 3, and an unactuated position in which the free end of armature 60 is held against supporting plate 58 by the force of tension spring 66, as shown by the broken lines in FIG. 6. Armature 60 normally rests in the unactuated position until coil 50 is energized to draw the free end of armature 60 toward it, or until a manually operated plunger 68 is depressed to move armature 60 toward pole piece 64 as described hereinafter.

A housing 70 made of electrical insulating material is clamped to supporting plate 58 and covers the interior of the relay and also serves as a support for the relay contacts and contact arms. Two flexible electrically conductive contact arms 72 and 74 (FIGS. 3 and 4) are attached by rivets 76 (FIG. 3) to corresponding terminals 78 and 80 which are staked to housing 70 and protrude outwardly therefrom. A double faced electrical contact 82 (FIG. 3) is attached to the free end of each contact arm 72 and 74 and is positioned in cooperative relation with stationary contacts 84 and 86 which are mounted on terminals 88 and 90, respectively, which are staked to housing 70 and protrude outwardly therefrom. Contacts 82 and 84 from normally closed contact pairs while contacts 82 and 86 form normally open contact pairs.

Contact closing pressure for normally open contacts 82 and 86 is applied to contact arms 72 and 74 by a yoke 92 which is made of electrical insulating material and is pivotally mounted on a telescoping actuator 94. Actuator 94 is slideably mounted in a main actuator stem 96 of plunger 68, which stem slideably extends through an opening in the web portion of frame 52 and in supporting plate 58, and nonslideably through the opening in armature 60. The portion of main plunger stem 96 which projects slideably through supporting plate 58 is accessible as at 68 for manual operation of the relay, and the telescoped actuator portion 94 is adapted to be moved by armature 60 when coil 50 is energized, due to engagement of armature 60 with the lugs 61. A compression spring 98 urges telescoped actuator 94 and plunger 96 toward their unactuated position, but movement may be caused by either a manual push on button 68 or by a push from armature 60 on lugs 61 of actuator 94 to move actuator 94 to its actuated position which is shown in FIG. 3.

The two piece structure of plunger 68, which allows telescoped actuator portion 94 to be moved to its actuated position by a manual push and by energization of coil 50, is described in detail in U.S. Pat. No. 3,622,925.

Yoke 92 is substantially U-shaped in cross-section (FIG. 3) and is pivotally attached to actuator 94 by means of two pintle trunnions 100 (FIGS. 3 and 4) which extend inwardly from the sides of yoke 92 midway of its length and ride in a longitudinal slot 102 in telescoped actuator 94. This slot is in a protrusion 103 which projects downwardly from the top of part 94 into a larger opening 104. Slot 102 permits pintle trunnions 100 to shift up and down therein. A modification is illustrated in FIG. 5, wherein the yoke 192, instead of carrying the trunnions 100, has the slots 202 and the trunnions 200 (which function is the same as the trunnions 100 of the form of the invention of FIG. 3) are carried by the upper end of the actuator 194. The actuator has an opening 204 corresponding to the opening 104 of the form of the invention of FIG. 4, and within the opening is the upper end of a spring 210 which corresponds to the spring 110 of the form of the invention of FIG. 4.

Larger opening 104 in actuator 94 has slots 106 and 108 on opposite sides of slot 102 to receive the upper portion of a compression spring 110. The lower end of spring 110 is received in the lower portion of opening 104 in part 94 and in a pocket 107 at the upper end of plunger stem 96 as in FIG. 3. The upper end of spring 110 bears on the bottom of yoke 92 (FIG. 4) to normally bias pintle trunnions 100 toward the upper portion of slot 102 (FIG. 4). Spring 110 permits a predetermined amount of overtravel of telescoped actuator 94 with respect to yoke 106 to compensate for contact wear and erosion. Improved operation can also be obtained by having spring pockets 120, one for each contact finger 72–74, depending from the top wall of the housing to each accommodate a spring 122, as shown in FIG. 3, which exert yielding pressure on the top of the contact fingers 72–74. By having the springs 122, it is practical to use contact fingers 72–74 having a lower spring rate and with better electrical conductivity.

Semispherical bosses 112 and 114 may be formed on the portion of yoke 92 which makes contact with contact arms 72 and 74, respectively.

Except for the overtravel permitted by slot 102 and spring 110 and related parts, the operation of this embodiment is the same as described above in connection with FIG. 1. When actuator 94 is moved toward contact arms 72 and 74, either by a manual push on plunger 68 or by energization of coil 50, yoke 74 is moved upwardly in FIGS. 3 and 4 to open contact pairs 82–84 and close contact pairs 82–86. Any lack of equalization in closing pressure on the two contact pairs 82–86 is automatically equalized by pivotal motion of yoke 92 about pintle trunnions 100. The level at which contact pressure is equalized is determined by the strength of overtravel spring 100. When the closing pressure on actuator 94 is released, spring 66 returns actuator 94 to its unactuated position, thereby moving yoke 92 away from contact arms 72 and 74, opening contact pairs 82–86 and closing contact pairs 82–84.

Various changes and modifications may be made without departing from the spirit of the invention, and all of such changes are contemplated as may come within the scope of the claims.

What I claim is:

1. In an electrical device having two flexible electrically conductive contact arms, each having a contact portion, said device having cooperating electrical contacts, and there being means for applying pressure to said arms to move the contact portions into closing engagement with said cooperating contacts, the improvement wherein said means for applying said pressure includes a movably mounted actuator mounted on said device reciprocably movable in a direction transversely of said contact arms and toward and away from said arms, and having an end portion movable toward said arms, and a yoke of electrical insulating material having a pivotal connection intermediate its ends with said actuator, said yoke extending transversely of said arms and being long enough to contact both arms and apply contact closing pressure thereto when said actuator is moved a predetermined distance toward said arms, said pivotal connection of said yoke tending to equalize contact closing pressure.

2. In an electrical device as claimed in claim 1 wherein said yoke has a bottom groove, and wherein the upper end of said actuator is pivotally connected in said groove.

3. In an electrical device as claimed in claim 2 wherein said yoke is U-shaped to provide said bottom groove.

4. In an electrical device as claimed in claim 1 wherein there is slot means associated with said pivotal connection providing for relative slideable movement between said actuator end and yoke in a direction axially of said actuator, and wherein there is spring means normally urging said yoke away from the end of said actuator.

5. The electrical device claimed in claim 3 wherein said pivotal connection between said yoke member and actuator member comprises trunnions projecting from one of said members, and wherein there is means on the other of said members pivotally receiving said trunnions.

6. The electrical device of claim 5 wherein said means for pivotally receiving said trunnions comprises a slot in one of said members extending axially of said actuator.

7. The electrical device of claim 6 wherein there is spring means urging said yoke away from said actuator end portion while permitting sliding of said trunnions in said slot to permit overtravel of said actuator end portion to compensate for contact wear and erosion.

8. The electrical device of claim 7 wherein said spring means is a coil spring, and wherein there is an opening in said actuator end portion for receiving said coil spring, with one end bearing against said actuator and with the other end bearing against said yoke.

9. The electrical device of claim 1 and further including spring means urging said actuator end portion and yoke away from said contact arms, and relay and armature means coupled to said actuator end portion for moving said actuator end portion and yoke toward said contact arms against the force of said spring.

10. The electrical device of claim 8 wherein there is a plunger, and wherein said actuator is telescopically mounted in said plunger, and wherein the actuator has an outer end with an elongated opening extending from side to side, and wherein there is a protrusion projecting into an end of said opening, which protrusion carries said pivot slot, said coil spring having its upper end surrounding said protrusion and having its lower end bottomed on the lower end of said actuator opening, and said plunger having its upper end provided with a pocket for accommodating the lower portion of said coil spring.

11. The electrical device of claim 1 and further including spring means engaging said contact arms to urge the same toward said yoke.

12. In a switch for controlling an electric circuit, which switch includes: a pair of fixed contact members in said circuit, a pair of flexible electrically conductive contact arms in said circuit each having a contact portion positioned for cooperation with said fixed contact members, an electromagnet, an armature supported for movement toward and away from said electromagnet, a spring connected with said armature normally biasing said armature toward a release position with respect to the electromagnet, a manually operable plunger supported for movement adjacent said armature, an actuator suported on said plunger for limited movement in an axial direction relative thereto, means between said plunger, armature and actuator for causing conjoint movement in response to initial pressure on the plunger, said actuator having a pressure end for causing movement of the flexible contact arms into engagement with the fixed contact members to complete the electric circuit and also energize the electromagnet in response to a predetermined amount of movement of the actuator whereby the armature is magnetically moved the rest of the way toward the electromagnet independently of plunger pressure, and means between the armature and actuator for maintaining the contact members in closed condition as long as the electromagnet is energized, the improvement wherein said pressure end of the actuator includes a yoke of electrical insulating material pivotally connected intermediate its ends to said actuator, said yoke extending transversely of said flexible contact arms and being long enough to contact both arms and apply contact closing pressure thereto when said actuator is moved a predetermined distance toward said arms, said pivotal connection of said yoke tending to equalize contact closing pressure on the pair off fixed contacts.

13. The electrical device of claim 12 wherein there is slot means associated with said pivotal connection providing for relative slideable movement between said actuator end and yoke in a direction axially of said actuator, and wherein there is spring means normally urging said yoke away from the end of said actuator.

* * * * *